US006374898B1

(12) United States Patent
Vogeler et al.

(10) Patent No.: US 6,374,898 B1
(45) Date of Patent: Apr. 23, 2002

(54) PROCESS FOR PRODUCING A CASTING CORE, FOR FORMING WITHIN A CAVITY INTENDED FOR COOLING PURPOSES

(75) Inventors: Konrad Vogeler, Küssaberg; Bernhard Weigand, Lauchringen, both of (DE); Hans Wettstein, Fislisbach (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/268,722

(22) Filed: Mar. 17, 1999

(30) Foreign Application Priority Data

Mar. 23, 1998 (EP) ..... 98 8102 50

(51) Int. Cl.[7] ..... B22C 9/10

(52) U.S. Cl. ..... 164/28; 164/516; 164/122.1; 164/369

(58) Field of Search ..... 164/28, 516, 228, 164/122.1, 369

(56) References Cited

FOREIGN PATENT DOCUMENTS

| | | |
|---|---|---|
| JP | 55114435 | 9/1980 |
| SU | 1435374 A | 11/1988 |

*Primary Examiner*—Kuang Y. Lin
(74) *Attorney, Agent, or Firm*—Burns, Doane, Swecker & Mathis, L.L.P.

(57) ABSTRACT

A process for producing a casting core which is used for forming within a casting a cavity intended for cooling purposes, through which a cooling medium can be conducted, the casting core having surface regions in which there is incorporated in a specifically selective manner a surface roughness which transfers itself during the casting operation to surface regions enclosing the cavity and leads to an increase in the heat transfer between the cooling medium and the casting.

8 Claims, 5 Drawing Sheets

$R / k_s = 125$

| Re | f | $f / f_0$ | $St / St_0$ |
|---|---|---|---|
| 40.000 | 0.0247 | 1.1 | 1.06 |
| 60.000 | 0.0248 | 1.23 | 1.14 |
| 80.000 | 0.0252 | 1.34 | 1.20 |
| 100.000 | 0.0256 | 1.44 | 1.25 |
| 400.000 | 0.02835 | 2.25 | 1.67 |

Figure 4A $R / k_s = 60$

| Re | f | $f / f_0$ | $St / St_0$ |
|---|---|---|---|
| 40.000 | 0.0319 | 1.426 | 1.25 |
| 60.000 | 0.0331 | 1.639 | 1.37 |
| 80.000 | 0.0342 | 1.819 | 1.46 |
| 100.000 | 0.0351 | 1.976 | 1.53 |
| 400.000 | 0.0360 | 2.860 | 1.94 |

Figure 4B

PROCESS FOR PRODUCING A CASTING CORE, FOR FORMING WITHIN A CAVITY INTENDED FOR COOLING PURPOSES

FIELD OF THE INVENTION

The invention relates to a process for producing a casting core, which is used for forming within a casting a cavity intended for cooling purposes, through which a cooling medium can be conducted.

BACKGROUND OF THE INVENTION

Casting cores are mold parts which are provided in a casting mold and displace the solidifiable material poured into the casting mold, and in this way form cavities in the cast end product, or casting. The production of heat-exposed products obtained as castings with the aid of the casting cores referred to above is of particular interest. Such end products are, for example, turbine blades which are exposed to very high temperatures in a gas turbine installation. To increase the service life of the turbine blades, they are provided in a known way with inner cooling channels, through which a cooling medium, preferably cooling air or water vapor, is passed for cooling purposes. Through cooling by means of constant heat removal, the material of the turbine blades is not heated up to the temperatures actually prevailing in its surroundings, thereby allowing the material to be preserved and its service life to be considerably prolonged.

In the area of the combustion chamber provided in a gas turbine installation it is also necessary for reasons relating to material-preserving aspects to cool the combustion chamber walls in a specifically selective manner and to provide them in a corresponding way with cooling channels.

In the cooling of turbine blades and in the cooling of combustion chamber walls there is the problem that the heat flow directed from outside onto the components is to be removed as efficiently as possible through the cooling fluid flowing through in the cooling channels. For this reason, the wall surfaces of the cooling channels taking part in the heat transfer should have internal heat transfer coefficients which are as high as possible. Various excitation mechanisms, such as the provision of ribs or pins for example, are used in most cases for this purpose, to increase the local surface area via which the heat flow is removed to the cooling fluid.

Furthermore, it is generally known that rough surfaces produce a greater heat transfer than smooth services. This effect is particularly dependent on the ratio of the height of the roughness to the hydraulic diameter of the cooling channel and on the ratio of the height of the local roughness to the thickness of the laminar underlayer of the flow and temperature boundary layer which forms when a cooling fluid flows through a cooling channel. However, roughness elevations on the surface of a cooling channel only have an influence on an increase in the heat transfer if they are of a height which rises above the laminar underlayer.

A great advantage of rough surfaces with regard to a desired increase in the heat transfer of a heated component to a cooling medium in comparison with the above known measures of using ribs and pins or similar heat-transfer-increasing internal components is essentially the much lower pressure loss which occurs when the cooling medium flows through a "roughened" cooling channel.

This relationship is to be explained in more detail with reference to FIG. 1. Plotted on the y axis of the diagram represented in FIG. 1 is the resistance coefficient f which a flow has when flowing through a flow channel, as a function of the Reynolds' numbers Re plotted on the x axis of the diagram. The graphs a to e entered in the diagram represent flow situations for different types of ribs in which a flow through a flow channel provided with lines of ribs. The solid line corresponds to the flow case of a through-flow channel with a smooth surface. The dashed line plotted directly above the solid line represents a flow case in which the through-flow channel has a roughened surface, with a roughness ratio $R/k_s$ of 60. R signifies here the hydraulic radius of the flow channel and $k_s$ corresponds to the magnitude of the equivalent sand grain roughness of the surface. For a through-flow channel with a diameter of 10 mm, the $R/k_s$ ratio of 60 corresponds to a roughness elevation of about 80 $\mu$m. It can be clearly seen from the function profiles entered in the diagram of FIG. 1 that the rough wall has an only approximately 50% higher resistance, and consequently pressure loss, than a smooth through-flow channel, but has a considerably lower pressure loss or resistance than the ribbed flow channels of cases a to e.

A further aspect in favor of the use of roughened surfaces in cooling channels can be explained with reference to FIG. 2, which shows a diagram which represents the "thermal performance" of turbulators, such as ribs for example, as opposed to a roughened surface. The values plotted on the y axis of the diagram in FIG. 2

$$G=(St/St_0)/(f/f_0)^{1/3}$$

which shows the relative increase in heat transfer for an equal pumping capacity in the system. These values consequently indicate the "thermal performance" of the system (of the ribs) and consequently their relative efficiency in comparison with a smooth channel. A value of G=1 in this case corresponds to a smooth channel.

Plotted on the x axis of the diagram in ascending sequence are Reynolds' numbers Re of the cooling medium within the flow channel. The function profiles a to e represent the efficiency of various rib arrangements within the flow channel, assuming that a constant pumping capacity is available. The steady decrease in efficiency G for various rib configurations with increasing Reynolds' numbers can be clearly seen. The dashed line, on the other hand, represents the case of a roughened surface within a cooling channel, which by contrast with the above function profiles has a curve which rises with increasing Reynolds' numbers. Even at Reynolds' numbers of approximately 100,000, the rough wall has better heat transfer properties than two known different types of ribs. If the function profile of the rough surface is extrapolated to even higher Reynolds' numbers, as are encountered in combustion chamber cooling systems for example, the rough surface inside cooling channels is the best solution if the object is to obtain the maximum increase in heat transfer for a given pumping capacity.

This is particularly true because, for very high Reynolds' numbers, only the conditions in the direct vicinity of the wall remain significant and the applied form of the turbulators merely blocks the outer flow and consequently increases the pressure loss, but no longer contributes to intensifying the heat transfer at the wall.

On the basis of the comments made above on the significance of a specifically selective incorporation of surface roughnesses in cooling channels, possibilities for producing specifically selective surface roughnesses, in cooling channels in particular, are to be specified.

The mold parts provided with cooling channels are preferably produced by means of casting processes and serve, for example, as subassemblies of gas turbine installations to be subjected to heat. The cooling channels within a turbine blade for example, can be very filigree and can be accessed from outside only with difficulty, or not at all, for local finishing after completion of the turbine blade. Ways by which a desired surface roughness can be obtained with a surface finish which has to conform to certain roughness values must be found. Since the end products concerned are produced within a casting process, ways of obtaining the desired surface roughness before or during the casting process, or while the cast end product is cooling down, must be found.

SUMMARY OF THE INVENTION

Accordingly, one object of the invention is to provide measures by which a desired surface roughness on the end product can be produced during the casting operation. In particular, inaccessible cavities within the end product, which are preferably designed as cooling channels, are to have a desired surface roughness without any finishing steps.

One solution for achieving the object on which the invention is based includes a process for producing a casting core for forming a casting having a cavity intended for cooling purposes through which a cooling medium can be conducted, the process comprising: providing the casting core with surface regions in which there is incorporated in a specifically selective manner a surface roughness which transfers itself during the casting operation to surface regions of the casting enclosing the cavity and leads to an increase in heat transfer between the cooling medium and the casting.

The invention is based on the idea of covering the casting cores which are to be provided for the casting operation, to produce cavities within the end product to be produced, with an artificial roughness which transfers itself during the casting operation to the surface of the end product to be produced, preferably to those surface regions which enclose a cavity which forms a cooling channel in the completed casting.

It has been perceived as a preference that the casting core intended for forming a cavity within the end product can be roughened by prior working of its surface. The degree of roughness transferred to the surface of the casting core can be applied, for example, by means of a core tool. For this purpose, the surface of the core tool is roughened to a desired extent by means of spark erosion. The degree of roughness to be applied to the core tool can be specifically set by the voltage to be applied to the spark electrode and/or by choosing the distance between the spark electrode and the core tool to be roughened.

The surface roughness applied in this way to the surface of the core tool transfers itself during the production process for the casting core to the casting core surface and subsequently during the casting process and the following cooling down of the end product to the corresponding inner surface contour of the end product.

Casting cores are usually produced from a figuline mass which has to be fired for hardening. Before firing, shaped casting cores are referred to as "green cores" and, to incorporate a surface roughness in this state or in the fired state, can be roughened by means of sand blasting or selective further roughening techniques, such as grinding and abrading operations for example.

Similarly, the casting core may be roughened as a green core with the aid of a cold or heated tool which has a defined roughness structure, by pressing into the surface of the casting core in the customary way.

Further roughening techniques which lead to a specifically selective surface roughness on the casting core are of course also conceivable; what is important is that a defined roughness is provided on the casting core in such a form as to allow a specifically set surface roughness to be produced in the end product, for example in the cooling channel of a turbine blade or in the cooling channel of a combustion chamber wall.

The surface roughness is to be set in such a way that it is adapted to the following flow conditions which prevail inside the cooling channel and to the desired heat transfer coefficient.

In principle, the following relationship between the resistance coefficient f and the heat transfer coefficient $\alpha$, or the Stanton number St, applies:

$$\frac{\alpha}{\alpha_0} = \frac{St}{St_0} = \left(\frac{f}{f_0}\right)^{0.63}$$

In the above equation, the variables denoted by the index zero represent reference variables of a smooth channel, while the variables without an index apply to a rough channel. In the event that the ratio $f/f_0$ is >4, this ratio is to be equated with 4.

After determining the desired increase in the heat transfer coefficient, the associated roughness variable $R/k_s$ can be read off from the diagram representation according to FIG. 3 (taken as a basis below) and used for producing the core tool. The maximum achievable increase in heat transfer in this case is, however, $St/St_0=2.4$. There is consequently no point in using roughnesses which make the resistance coefficient more than 4 times as great as in the case of a smooth channel wall surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
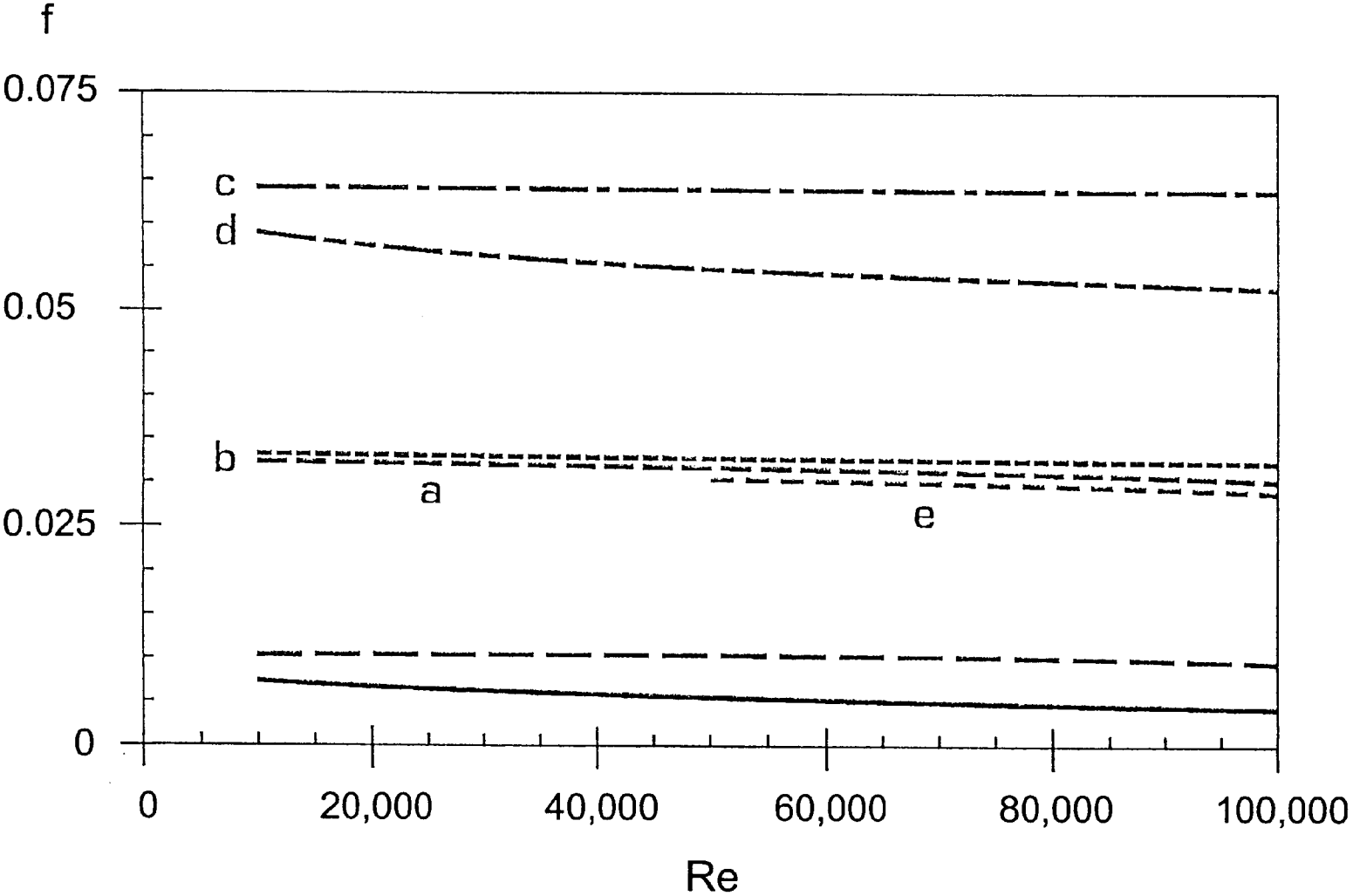
FIG. 1 shows a diagrammatic representation to represent the resistance coefficient f of variously designed cooling channels.
Figure 2:
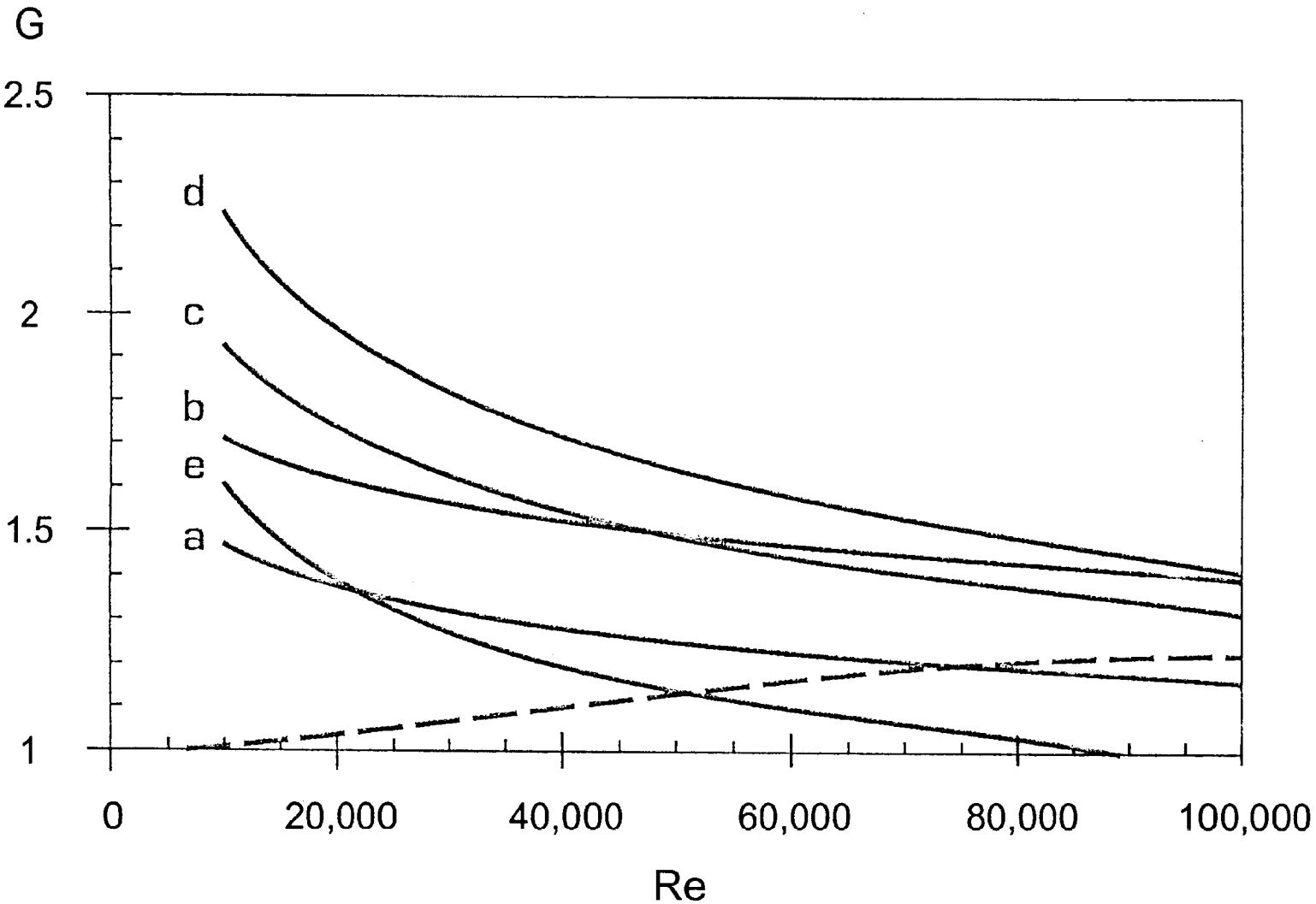
FIG. 2 shows a diagrammatic representation of the efficiency function of variously formed cooling channels.

Referring now to the drawings, wherein like reference numerals designate identical or corresponding parts throughout the several views, reference is made to the comments made above with respect to FIGS. 1 and 2.

Figure 3:
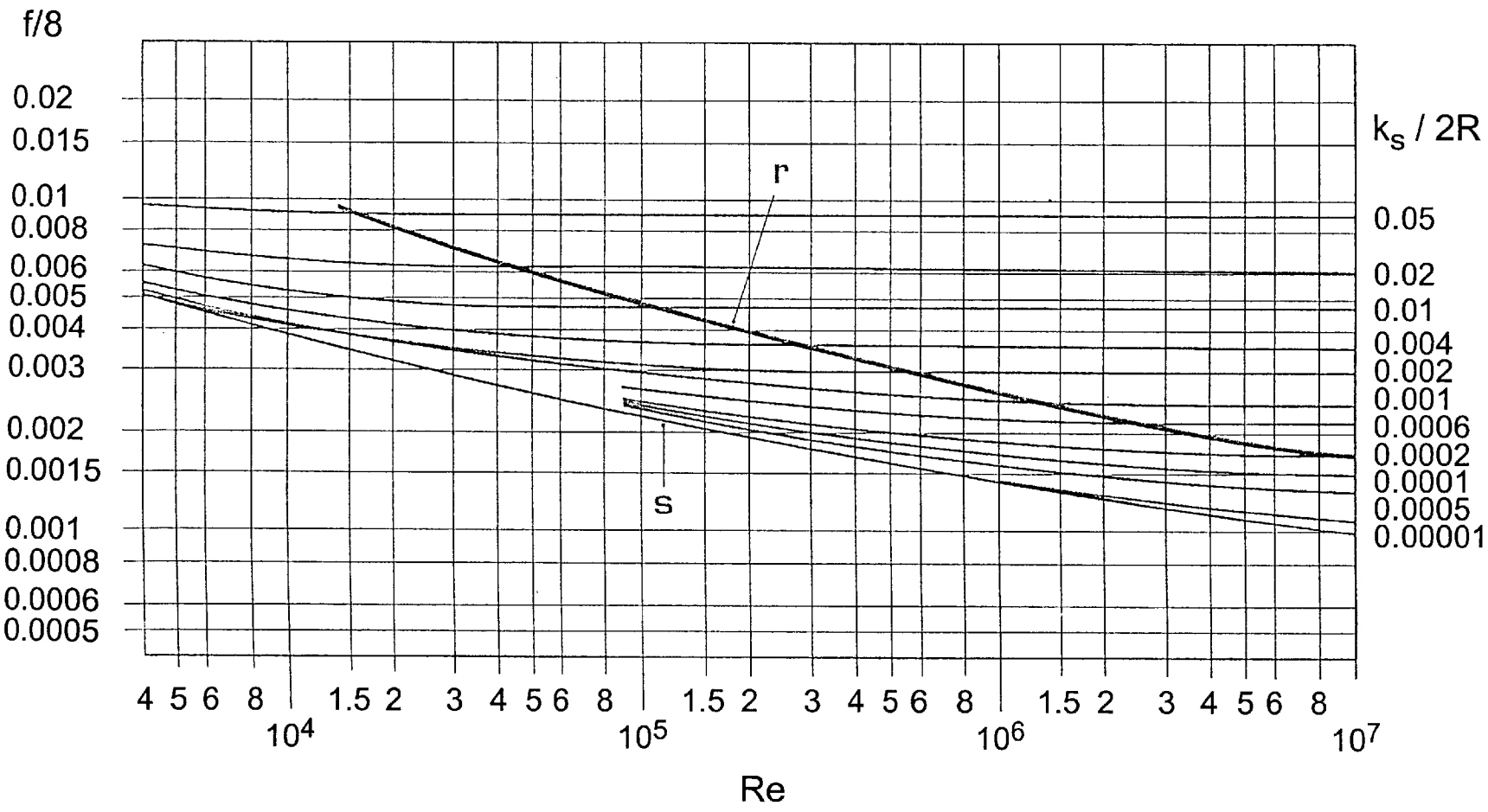
FIG. 3 shows the resistance coefficient as a function of the Reynolds' number for various wall roughnesses, FIGS. 4*a, b* show tables for increasing the heat transfer by the specifically selective incorporation of roughnesses for various Reynolds' numbers and FIGS. 5*a, b* show a schematized cross-sectional representation of a wall provided with lines of ribs, with and without surface roughness.

The diagram in FIG. 3 shows the dependence of the resistance coefficient f on the Reynolds' number Re for various heights of roughness $k_s/2R$. Shown in the diagram are, first of all, the two characteristic curves for the profile of the resistance coefficient f for a smooth channel s and the limiting case of a completely rough channel r. The smooth channel has in this case a very small roughness, typically with a roughness Reynolds' number $Re_k$ of <5. This relationship is also disclosed by the books by Hays+Crawford, "Convective Heat and Mass Transfer", McGraw Hill Inc., ISBN 0-07-033721-7, 1993 or O. Tietjens, "Str öbmungslehre, 2. Teil" [fluid mechanics, 2nd part], Springer Verlag, 1970.

The second case is with $Re_k$=70, which represents a limiting height for roughness. If this height of roughness is exceeded, it can be observed that the resistance coefficient for a rough channel remains constant for all Reynolds' numbers.

The curves entered in FIG. 3 for various values of the height of roughness $k_s/2R$ accordingly assume a constant value in each case for the resistance coefficient f whenever they lie to the right of this line in the diagram.

When incorporating a specifically selective roughness to increase the heat transfer by, for example, 20%, in comparison with a smooth channel, i.e. $1.2.\alpha_0$, the resistance coefficient f increases by about 33%. FIG. 3 shows, for example, that for a Reynolds' number of 100,000, the desired increase in heat transfer can be achieved with an increase in roughness of $k_s/2R=0.008$. This means that, for a cooling channel with a diameter of 10 mm, an increase in roughness of 40 $\mu$m is required in order to ensure the required increase in heat transfer.

The tables indicated in FIGS. 4*a* and *b* show two cases for different heights of roughness $R/k_s$, which are intended to illustrate the resulting increase in heat transfer $St/St_0$ for various Reynolds' numbers Re. It can be clearly seen how the roughness intensifies the heat transfer with increasing Reynolds' numbers.

For $R/k_s$=60, for example, the heat transfer coefficient for a Reynolds' number of 100,000 is 50% greater than in the case of a smooth wall with $R/k_s$125 (compare the associated $St/St_0$ values)

Figure 5A:
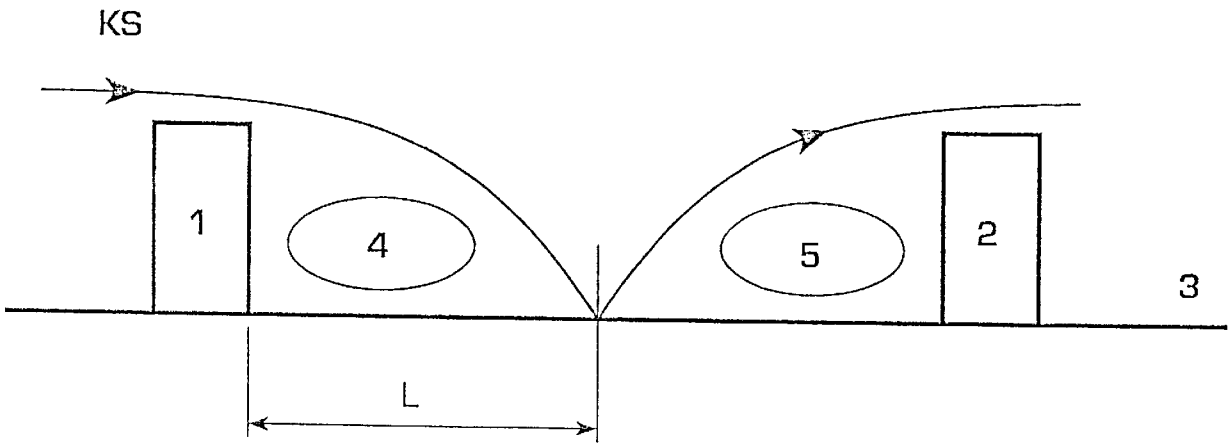

In FIG. 5, cross sections through a cooling wall surface 3, which is in each case provided with lines of ribs, are represented in the sub-figures a and b. In the case of FIG. 5*a*, two lines of ribs 1, 2 rise up perpendicularly above the cooling wall surface 3 and represent a resistance to the cooling flow KS flowing over the lines of ribs 1, 2. The flow KS passing through the cooling channel is separated from the wall 3 by each line of ribs, lee vortex 4 forming downstream of every line of ribs and stagnant vortex 5 forming upstream of every line of ribs.

When providing a surface roughness between individual lines of ribs, as is represented in the case example of FIG. 4*b*, the roughness between the lines of ribs effects a change in the flow KS by means of a stronger wall shear stress and consequently an intensification in the heat transfer.

Figure 5B:
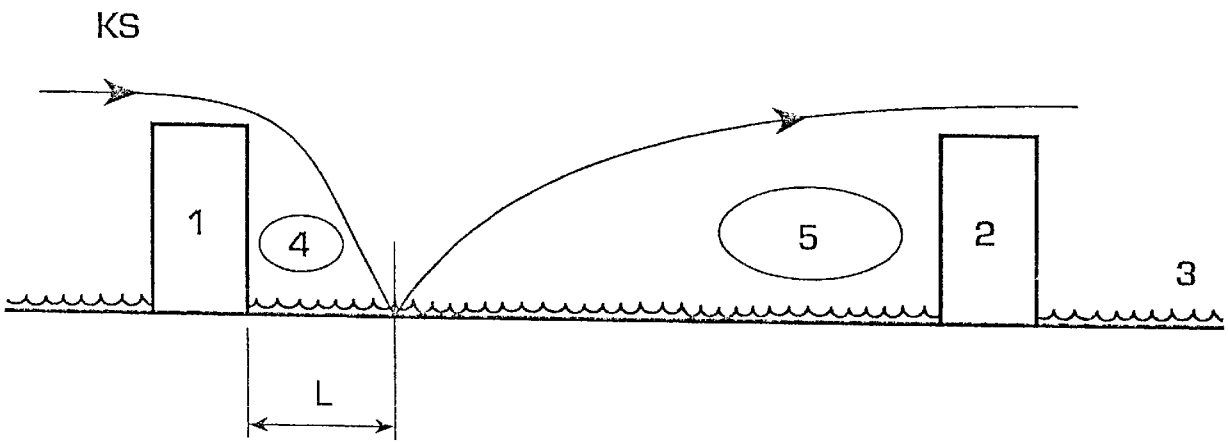

It is evident from the comparison of FIGS. 5*a* and 5*b* that the length L of the separation zone, in which the flow is at a distance from the cooling wall after each line of ribs, is shortened by the wall roughness. This means that, in the "roughened case", the ribs can be brought closer together and consequently the thermal loading per unit length of the component can be increased.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A process for producing a casting having a cavity with a predetermined surface roughness adapted to conduct a cooling medium therethrough, the method comprising:

(a) providing a casting core with a surface roughness equivalent to the predetermined surface roughness of the cavity; and (b) defining the cavity and transferring the surface roughness of the casting core to the cavity during a casting operation;

wherein the surface roughness in step (a) is selected so as to define a ratio $R/k_s$ of approximately 60–120 when the surface roughness is transferred to the cavity in step (b), where R=the hydraulic radius of the cavity and $k_s$=the equivalent s and roughness of the cavity.

2. The process as claimed in claim 1, wherein the surface roughness of the casting core is adapted to a desired heat transfer coefficient which is produced when the cooling medium flows over rough surface regions within the casting which enclose the cavity.

3. The process as claimed in claim 1, wherein the casting core consists of a figurine mass which is made to harden in a further production step.

4. The process as claimed in claim 1, wherein a core tool, the surface of which is roughened in a specifically selective manner by means of spark erosion, is applied to the surface of the casting core to roughen the surface of the casting core.

5. The process as claimed in claim 1, wherein the method comprises sand blasting the surface of the casting core.

6. The process as claimed in claim 1, wherein the method comprises pressing roughness structures into the surface of the casting core, using cold or heated pressing tools.

7. The process as claimed in claim 4, wherein the core tool is roughened before it is used for producing the casting core.

8. The process as claimed in claim 1, wherein notches which produce lines of ribs and a defined roughness on the cavity surface of the casting during the casting operation are formed in the casting core.

* * * * *